United States Patent [19]

Muller

[11] Patent Number: 5,028,045

[45] Date of Patent: Jul. 2, 1991

[54] APPARATUS FOR TAKING OVER PRINTING PRODUCTS FROM A ROTATABLY DRIVEN PADDLE WHEEL OF A PRINTING MACHINE

[75] Inventor: Erwin Muller, Oberdürnten, Switzerland

[73] Assignee: Ferag AG, Hinwil, Switzerland

[21] Appl. No.: 543,885

[22] Filed: Jun. 27, 1990

[30] Foreign Application Priority Data

Jul. 10, 1989 [CH] Switzerland ..... 02567/89

[51] Int. Cl.[5] ..... B65H 5/02; B65H 5/24

[52] U.S. Cl. ..... 271/271; 271/187; 271/315

[58] Field of Search ..... 271/187, 315, 271

[56] References Cited

U.S. PATENT DOCUMENTS 4,487,408 12/1984 Fischer ..... 271/271 X
4,886,260 12/1989 Reist .
4,886,264 12/1989 Haensch ..... 271/187 X

FOREIGN PATENT DOCUMENTS 0312749 4/1989 European Pat. Off. .

*Primary Examiner*—Richard A. Schacher
*Attorney, Agent, or Firm*—Fleit, Jacobson, Cohn, Price, Holman & Stern

[57] ABSTRACT

Cams (36, 36') are arranged in each case laterally offset alternately on the chain (34) of the cam conveyor (30). The cams (36) are swivelled by the swivel rocker arm (44) into catching position (46), in which they are always actively conveying. Depending on the position of the control rocker arm (54), the cams (36') which can be switched away are left in their rest position (50) or likewise swivelled into the catching position (46). A retaining device (56), which holds back the printing products (18) deposited thereupon until they are pushed off by a cam (36, 36'), is provided at the depositing point (24). With the cams (36') which can be switched away actively conveying, each printing product 18 is individually seized by a cam (36, 36') and conveyed away in an imbricated formation. If the cam (36') which can be switched away are not actively conveying, two printing products (18) are in each case deposited one on top of the other and conveyed away by the cams (36) always actively conveying in an imbricated formation.

7 Claims, 3 Drawing Sheets

Figure 1:
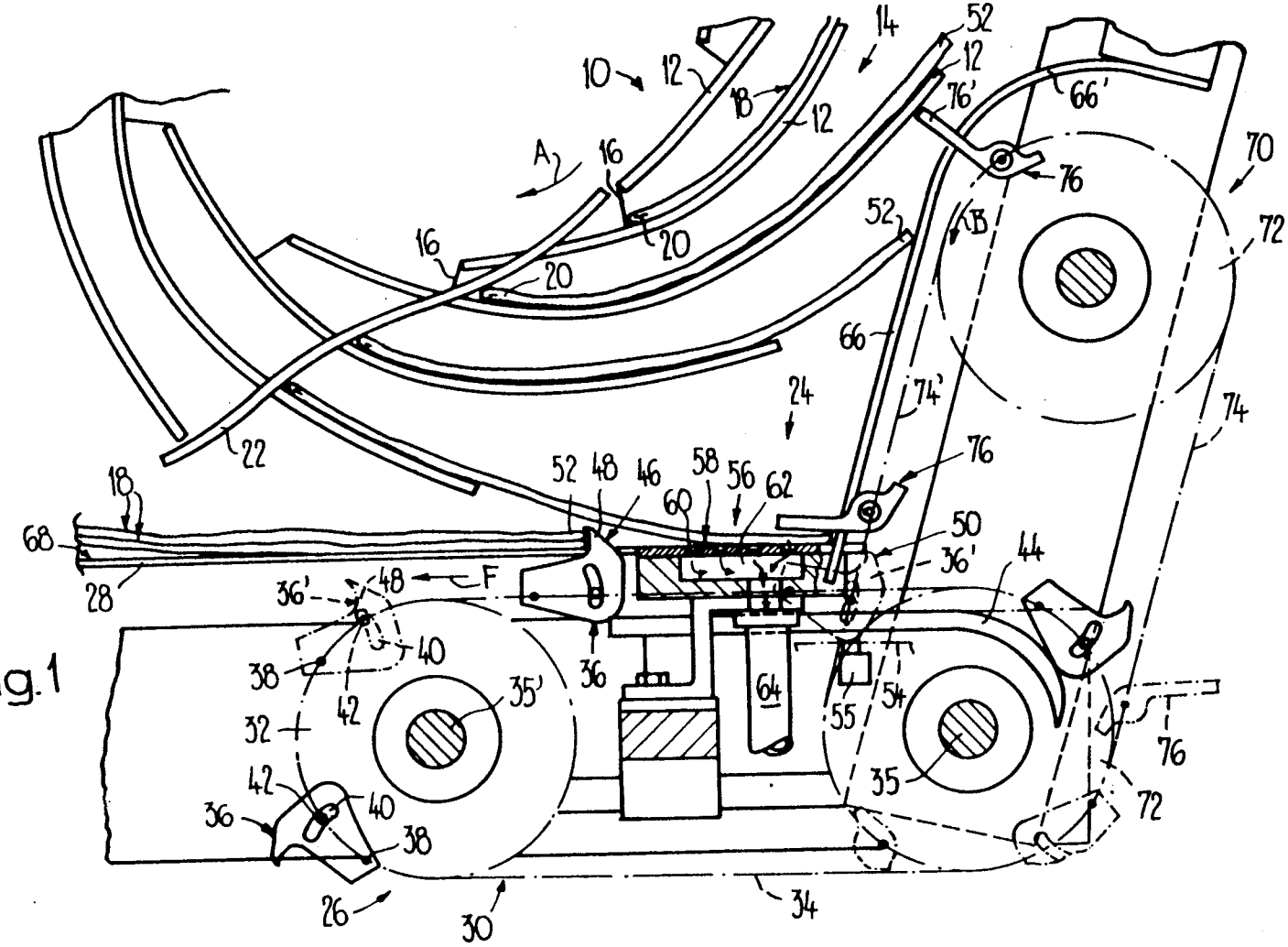

APPARATUS FOR TAKING OVER PRINTING PRODUCTS FROM A ROTATABLY DRIVEN PADDLE WHEEL OF A PRINTING MACHINE

The present invention relates to an apparatus for taking over printing products, in particular folded printing products, from a rotatably driven paddle wheel of a printing machine, according to the preamble of claim 1.

EP-A 0 179 992 discloses such an apparatus. Signature sheets are deposited on a delivery conveyor by means of a paddle wheel one on top of the other to form stacks. The delivery conveyor has a belt with transport fingers arranged at intervals one behind the other, the synchronization of paddle wheel and belt being set in such a way that a transport finger transports a stack away when a predetermined number of signature sheets have been deposited one on top of the other and the first signature sheet of the following stack is still floating between the paddle wheel and the depositing point. In order to prevent the first signature sheet of the following stack being taken along by the finished stack to be transported away, a retaining device for this signature sheet is provided at the depositing point. In order to be able to move the belt at a reduced speed with the same number of stacks to be formed per unit of time, an imbricated formation is formed from the stacks on the delivery conveyor. In order to set on this known apparatus the number of signature sheets deposited one on top of the other to form a stack, the synchronization of the delivery conveyor with the paddle wheel must be changed.

Furthermore, EP-A 0 265 735, or the corresponding U.S. Pat. No. 4,886,260, and EP-A-0 312 749 or the corresponding U.S. Pat. No. 4,886,264 disclose apparatuses for taking over folded printing products from a rotatably driven paddle wheel of a printing machine in which the printing products are deposited onto a delivery conveyor in an imbricated formation in which each printing product in each case rests in an imbricated manner on the preceding one. The delivery conveyors have on a drawing member, driven in circulation, grippers or cams for productwise conveying away of the printing products, which grippers or cams are arranged at intervals one behind the other, can be brought into effect on the printing products in the region of the trailing edges and are controllable. The cams are mounted in a swivelling manner on the drawing member and are swivelled into the area of the printing products by means of a fixed-in-place rocker arm in the region of the effective conveying zone of the delivery conveyor.

It is an object of the present invention to provide an apparatus of the generic type which allows the formation, according to choice, of imbricated formations in which each printing product rests in each case in an imbricated manner on the preceding one, or two or more printing products lying one on top of the other in each case rest in an imbricated manner on the preceding printing products, without adaptation of the synchronization between the paddle wheel and delivery conveyor.

This object is achieved by the features of the defining part of claim 1.

At least every second catch of a delivery conveyor can be switched away out of the area of effect on the printing products. When the catches are not switched away, each printing product is seized at its trailing edge and conveyed away, resting in an imbricated manner on the preceding printing product. If every second catch is switched away out of the area of effect on the printing products, two printing products, deposited one on top of the other, are seized by each actively conveying catch, these two printing products, lying one on top of the other, in each case resting in an imbricated manner on the preceding pair of printing products. In this case, neither the synchronization between the paddle wheel and the delivery conveyor nor the speed of the catches has to be changed. If two catches arranged one behind the other can respectively be switched away out of the area of effect on the printing products and every third catch effectively conveys, in each case three printing products, deposited one on top of the other, are conveyed away by said catche.

A particularly preferred embodiment of the apparatus according to the invention, by means of which an extremely precise imbricated formation is possible, is specified in claim 7. The trailing edges of the printing products are led by catching elements of a guiding device to the depositing point and firmly held there by said catching elements until the latter have passed the depositing point.

Further preferred embodiments of the apparatus according to the invention are specified in the further dependent claims.

Figure 2:
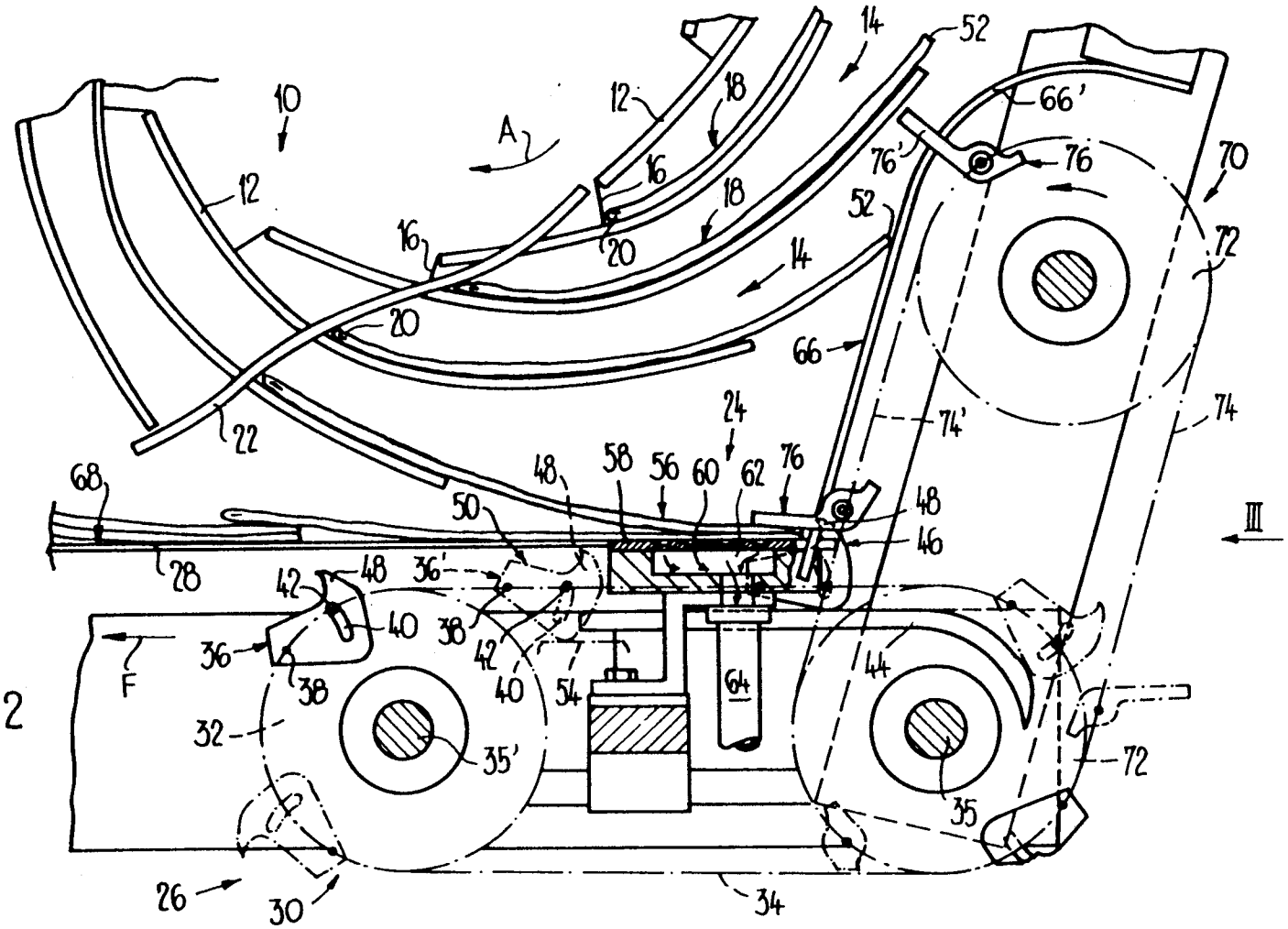
Figure 3:
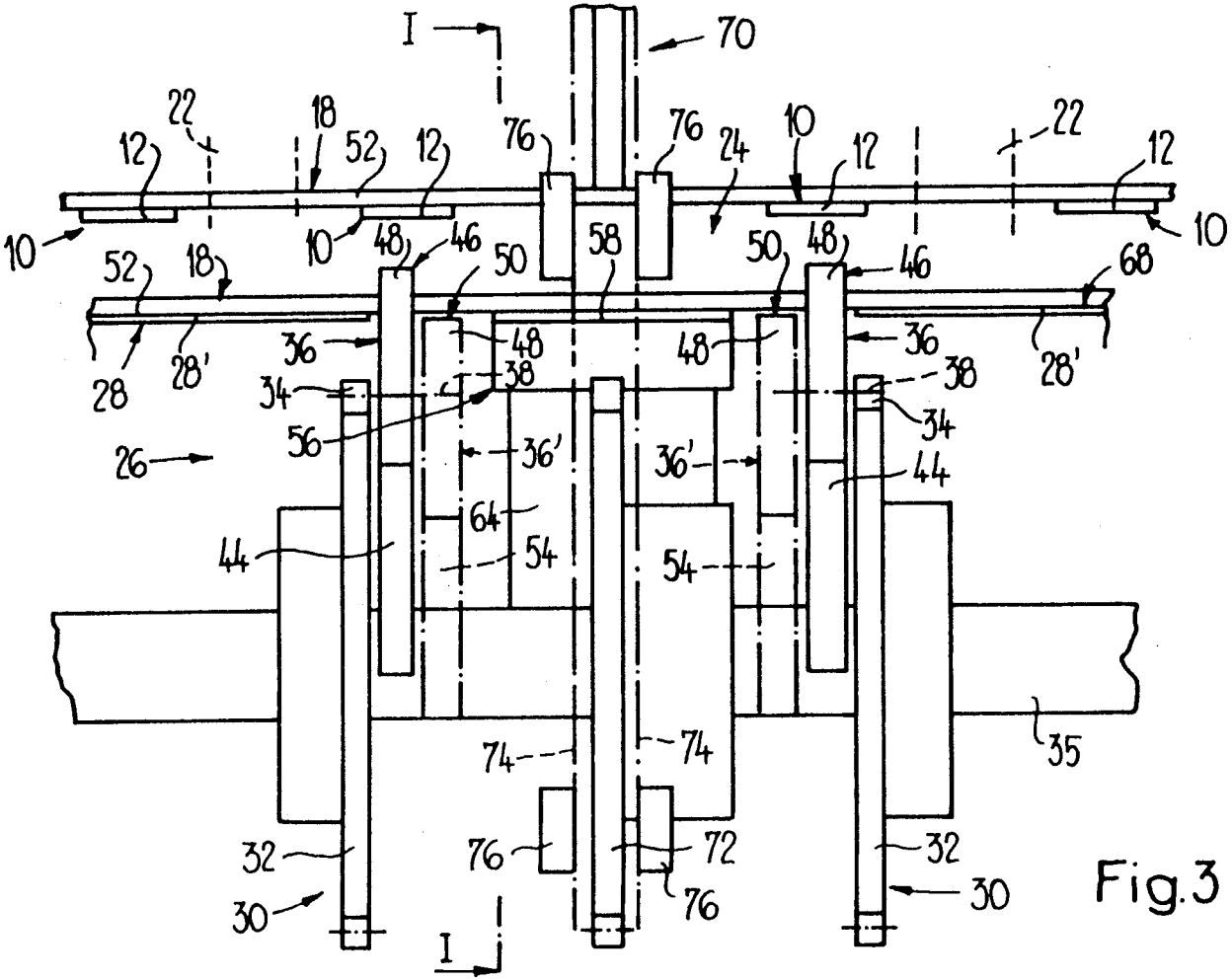

The invention is now described in more detail with reference to an exemplary embodiment represented in the purely diagrammatic drawing, in which:

FIGS. 1 and 2 show the apparatus, in section along the line I—I of FIG. 3, at two different points in time of an operating cycle, and FIG. 3 shows, simplified, a side view in the direction of the arrow III of FIG. 2.

The apparatus shown in FIGS. 1 to 3 has a paddle wheel arrangement of a printing machine with four paddle wheels 10, which are arranged next to one another, are rotatably driven in arrow direction A and only one of which is visible in the FIGS. 1 and 2. Each paddle wheel 10 has radially arranged paddles 12, which bound pockets 14, which are closed off at their inner end by means of a base 16. In a known way which is not shown, folded printing products 18, such as for example newspapers, periodicals or parts thereof, are inserted with their fold 20 ahead into the pockets 14. An ejecting member 22 is provided in each case between the paddle wheels 10 respectively arranged on one side. In the course of rotation of the paddle wheels 10 in arrow direction A, the printing products 18 make contact with their leading fold 20 with the ejecting member 22, as a result of which the printing products 18 are ejected from the pockets 14 and deposited onto a delivery conveyor 26, arranged underneath the paddle wheels 10, at a depositing point denoted by 24.

The delivery conveyor 26 has underneath a two-part delivery plate 28, the parts 28' of which are laterally spaced apart (FIG. 3), a cam conveyor 30 with two chains 34 led around sprockets 32. The mutually corresponding sprockets 32 are mounted on common shafts 35, 35'. The chains 34 are driven in circulation synchronously to each other in conveying direction F and have cams 36, 36' arranged at fixed intervals one behind the other. The two mutually parallel-running chains 34 are spaced far enough apart in a direction at right angles to the conveying direction F that the respective cams 36, 36' run through between and adjacent to the delivery plate parts 28'.

The cams in solid lines and denoted by 36 are arranged directly alongside the chain 34 on the latter, whereas the cams respectively provided in between, drawn in dotted-dashed lines and denoted by 36', are mounted on the chain 34 spaced further away from said chain, alongside the cams 36 (see in particular FIG. 3). The cams 36, 36' are of an identical design and are swivel-mounted on the chain 34 by means of a bolt 38 each. Each cam 36, 36' has, following behind the bolt 38, seen in conveying direction F, a slot 40, which is concentric to the bolt 38 and through which a limiting bolt 42, likewise fastened to the chain 34, runs. The limiting bolt 42 limits the swivelling movement of the cams 36, 36'.

The cams 36 of each chain 34 are assigned a fixed swivel rocker arm 44, which, seen in conveying direction F, extends from the region of the sprocket 32 ahead of the depositing point 24 until shortly before the other sprocket 72. On running onto the swivel rocker arm 44, the cams 36 are swivelled counterclockwise into their catching position, denoted by 46, in which they project in the region of the delivery plate 28 beyond the latter with their catch lugs 48. On running off the swivel rocker arm 44, the cams 36 swivel under their own weight, or possibly under the force of a spring, clockwise from the catching position 46 into a rest position 50, in which the free ends of the catch lugs 48 are arranged underneath the surface of the delivery plate 28. The rest position 50 is shown for the example of a cam 36'. On swivelling of the cam 36 out of the catching position 46 into the rest position 50 at the end of the swivel rocker arm 44, the catch lugs 48 swivel out of the area of effect on the trailing edges 52 of the printing products 18 deposited onto the delivery plate 28 and conveyed away by means of the cams 36, without thereby damaging the open trailing edge 52 opposite the fold 20. It must be noted here that the swivelling of the cams 36 into their rest position 50 takes place before the cams 36 run onto the circumference of the sprocket 32.

The cams 36' are assigned a control rocker arm 54, of a similar design to the swivel rocker arm 44. Said control rocker arm is only indicated by dotted-dashed lines over a region of its length in FIGS. 1 and 2. The control rocker arm 54 can be brought by means of a control device 55, only shown diagrammatically in FIG. 1, from its rest position shown in the figures into a swivelled position, in which it is located on a level with the swivel rocker arm 44, and back again. If the control rocker arm 54 is located in its rest position, the cams 36' in the region of the control rocker arm 54 remain in the rest position 50, whereas with the control rocker arm 54 raised into the swivelled position they swivel into the catching position 46, in which the catch lugs 48 of the cams 36' reach out over the delivery plate 28. Thus, with the control rocker arm 54 located in the rest position, only the cams 36 are actively conveying, whereas with the control rocker arm 54 located in the swivelled position both the cams 36 and the cams 36' are actively conveying.

At the depositing point 24, a retaining device denoted by 56 is provided. The latter has a perforated plate 58, which is flush with the delivery plate 28, arranged between the chains 34 and the holes 60 of which open into a channel 62, which is connected via a line 64 to a low-pressure source (not shown). The flow of the air sucked in from the low-pressure source is indicated by arrows. The printing product 18 which happens to be resting directly on the perforated plate 58 is held by the retaining device 56 in the region bordering the trailing edge 52 as a consequence of the low pressure.

A deflecting member 66, which has in its upper end region an entry curve 66', directed away from the paddle wheel 10, and the lower end region of which crosses the conveying plane 68 defined by the delivery plate 28, runs along the path of movement of the trailing edges 52 during the ejection from the pockets 14 of the paddle wheel 10. The deflecting member 66 is not shown in FIG. 3 for the sake of better clarity.

An aligning and pressing arrangement 70 is provided on the side of the deflecting member 66 facing away from the paddle wheel 10. Said aligning and pressing arrangement has an endless chain 74, which is led around two further sprockets 72 and to which pressers 76 are fastened in pairs at certain intervals. The lower sprocket 72 is mounted on the same shaft 35 as the sprocket 32 of the cam conveyor 30 upstream of the depositing point 24, seen in conveying direction F. The active side 74' of this endless chain 74 runs parallel to the deflecting member 66 and crosses the conveying plane 68 adjacent to the retaining device 56. The pressers 76 are swivel-mounted on the endless chain 74 and, in their rest position shown in the figures, protrude approximately at right angles to the endless chain 74 from the latter in an outward direction, so that the arms 76' of the pressers 76 project in the region of the deflecting member 66 beyond the latter in the direction of the paddle wheel 10. On running onto the retaining device 56 or onto a printing product 18 deposited thereupon, the pressers 76 can be swivelled clockwise counter to the force of a spring. After running past the retaining device 56, the pressers 76 swivel back again into their rest position shown in the figures. Such pressers 76 and their operating principle are described in EP-A 0 312 749 or the corresponding U.S. Pat. No. 4,886,264. The distance between two successive pressers 76 is greater than the distance between the trailing edge 52 of two printing products 18 arranged in adjacent pockets 14 during the ejection from the paddle wheel 10. However, the endless chain 74 is driven in circulation in arrow direction B counter to the direction of rotation A of the paddle wheel 10 at a speed which is greater than the circumferential speed of the paddles 12, to be precise in such a way that each pocket 14 or each printing product 18 arranged therein is assigned a presser 76.

The aligning and pressing arrangement 70 is synchronized with the paddle wheel 10 in such a way that, seen in direction of rotation A, a presser 76 in each case comes to rest behind the printing product 18 to be ejected and picks the latter up during the course of movement to the depositing point 24. In the region of the depositing point 24, the printing product 18 is then moved in the region of its trailing edge 52 by the presser 76 against the perforated plate 58, brought into contact and pressed thereupon until the presser 76 has passed the retaining device 56 and been swivelled by the latter clockwise out of engagement with the respective printing product 18.

In FIG. 1, two printing products 18, deposited one on top of the other, lie on the delivery plate 28 and, seized by a cam 36, are conveyed away in conveying direction F. The region of the trailing edge 52 of a further printing product 18 rests on the perforated plate 58 of the retaining device 56 and is pressed against there by means of a presser 76. The next-following printing product 18 counter to arrow direction A lies with its trailing edge 52 against the deflecting member 66 and behind it there is a further presser 76.

In FIG. 2, the two printing products 18 deposited one on top of the other have been released by the cam 36. These two printing products 18 lying one on top of the other rest with the region of their fold 20 on the preceding pair of printing products 18 (not shown) and are conveyed away by means of a conveyor (not shown), for example a belt conveyor, downstream of the cam conveyor 30. The printing product 18 bearing with the region of its trailing edge 52 on the retaining device 56 has been released by the corresponding pocket 14 and now rests with the region of its fold 20 in an imbricated manner on the two printing products 18 deposited one on top of the other. A further printing product 18 now rests with the region of its trailing edge 52 at the depositing point 24 on the printing product 18 already deposited and is pressed against the latter by means of the corresponding presser 76. A cam 36 of the cam conveyor 30 runs, seen in arrow direction F, onto the trailing edges 52 of these two last-mentioned printing products 18 and, as soon as they have been released by the presser 76, will push them in arrow direction F off the retaining device 56.

The apparatus shown operates as follows:

In order to form an imbricated formation in which two printing products 18 in each case rest in an imbricated manner on the preceding printing products 18, the control rocker arm 54 assigned to the cams 36' is held in its lower rest position, shown in the figures, so that only the cams 36 are actively conveying in each case and the cams 36' in the region of the retaining device 56 and the delivery plate 28 are in the rest position 50. As is shown in FIG. 1, a printing product 18 is deposited with the region of its trailing edge 52 onto the retaining device 56 and pressed against it there by the corresponding presser 76 until the latter is swivelled out of engagement with the printing product 18 by the retaining device 56. This printing product 18 cannot be conveyed away by the cam 36' in the rest position 50 and is held back by the retaining device 56 from being taken along by the printing products 18 already deposited one on top of the other and conveyed away in conveying direction F. The printing product 18 held by the retaining device 56 has another one deposited onto it (FIG. 2), which in turn is held back by a corresponding presser 76 in the region of the retaining device 56, until the presser 76, by passing by the retaining device 56, is swivelled by the latter out of the area of effect on the printing products 18. A cam 36 then makes contact with the trailing edges 52 of the printing products 18 deposited one on top of the other as soon as the presser 76 has released the printing products 18 and pushes them away from the retaining device 56. In this case, the folds 20 of these printing products 18, deposited one on top of the other, rest on the two printing products 18 preceding in conveying direction F, deposited one on top of the other. The next-following printing product to be ejected from the paddle wheel 10 in turn comes to rest on the perforated plate 58 of the retaining device 56, as shown in FIG. 1. It must be noted that, due to the higher circumferential speed of the pressers 56 in relation to the speed of the trailing edges 52, the pressers 76 do not properly and correctly seize printing products 18 lying in the pockets 14 and push them forward in arrow direction A until they bear in an aligned manner against the ejecting member 22. Moreover, the pressers 76 keep pressing the printing products 18 against the retaining device 56, or against the printing product 18 deposited thereupon, until the printing product 18 making contact with the perforated plate 58 is held sufficiently firmly by the retaining device 56 as a consequence of the low pressure building up, or the friction between the two printing products 18 deposited one on top of the other is great enough that the upper printing product 18 cannot be taken along by the paddle 12, on which it still rests with its leading region.

In order to form an imbricated formation in which each printing product 18 in each case rests in an imbricated manner on the preceding printing product 18, the control rocker arm 54 is raised into the upper swivelled position, so that both the cams 36 and the cams 36' are actively conveying. This has the consequence that each printing product 18 ejected from the paddle wheel 10 is seized individually by a cam 36 or 36' and conveyed away in conveying direction F. In this operating mode, it is no longer essential for the retaining device to be in operation. That is to say that it remains connected to the low-pressure source or the low-pressure source is functioning. After all, the pressers 76 temporarily hold back the printing product 18 bearing against the retaining device 56 against being taken along by the preceding printing product or the respective paddle 12. However, in order to achieve an extremely precise imbricated formation, the retaining device 56 is advantageously switched on even in this operating mode.

It must be noted that, for changing over from one mode to the other, no speed adaptations or synchronization variations have to be performed between the paddle wheel 10, the delivery conveyor 26 and the aligning and pressing arrangement 70. All that has to be done is either to keep the control rocker arm 54 in its lower rest position, as shown in the figures, or to raise it into the swivelled position, in which it is at the same level as the swivel rocker arm 44.

Due to the fact that the printing products 18 are guided or held during the entire delivery operation, an extremely precise imbricated formation is achieved. In an imbricated formation in which two printing products 18 in each case rest in an imbricated manner on the respectively preceding pair of printing products 18, the distance between the trailing edges 52 or folds 20 of two pairs of printing products 18 in each case corresponds to the distance between two successive cams 36, whereas in an imbricated formation in which each printing product 18 rests in an imbricated manner on the preceding one, the distance between the trailing edges 52 corresponds to the distance between the cams 36 and 36'.

It is also conceivable for controllable grippers to be arranged on the chain 34 of the delivery conveyor 26, of which grippers again at least every second one can be brought out of the area of effect on the printing products 18. These grippers seize the deposited printing products 18 in the region of their trailing edges 52, as disclosed for example by EP-A 0 12 749 and 0 265 735 or the corresponding U.S. Pat. No. 4,886,264 and U.S. Pat. No. 4,886,260, respectively. Of course it is also possible to arrange the cams which are always effectively conveying on one drawing member and to provide a further drawing member for the cams which can be switched away, the drawing members being driven synchronously to each other and mutually offset by half a division of the cams, at least for the conveying away of the printing products in an imbricated formation in which each printing product rests in an imbricated manner on the preceding one. For the depositing of in each case two printing products one on top of the other, the second drawing member can then be switched off and the respective cams held swivelled out of the area of effect on the printing products. For guiding the printing products in the region of their trailing edges during ejection from the pockets of the paddle wheel, it is also conceivable to provide instead of the deflecting member 66 and the aligning and pressing arrangement 70 a belt which is driven in circulation and with which the printing products make contact with their trailing edges.

The retaining device 56 may be connected to the low-pressure source intermittently in time with the printing products 18 to be conveyed away, or permanently. In any event, the cam conveyor 30 pushes the printing products 18 away in a precisely aligned manner, since the cams 36, 36' act on them in pairs.

The retaining device may also be of a different design than is shown in the exemplary embodiment, for example it may have a retaining finger or gripper in order temporarily to hold firm the respective printing products.

I claim:

1. An apparatus for taking over printing products, in particular folded printing products, from a rotatably driven paddle wheel of a printing machine, having a delivery conveyor, which is arranged underneath the paddle wheel and has catches for conveying away the printing products in an imbricated formation, which catches are arranged at intervals one behind the other, are driven in the conveying direction of the delivery conveyor and can be brought into effect on the trailing edges of the printing products deposited onto the delivery conveyor at a depositing point, and having a retaining device, arranged at the depositing point, for holding back the printing product respectively arriving in the effective area of the retaining device, wherein at least every second catch (36') can be switched away out of the area of effect on the printing products (18).

2. An apparatus as claimed in claim 1, wherein the catches (36, 36') are arranged on a drawing member driven in circulation, preferably a conveying chain (34), and a control device (54, 55) is provided for the catches (36') which can be switched away.

3. An apparatus as claimed in claim 2, wherein the catches (36') which can be switched away are arranged on the drawing member (34) laterally offset in relation to the catches (36) which are always effectively conveying.

4. An apparatus as claimed in claim 2, wherein all the catches (36, 36'), preferably cams, on the drawing member (34) are mounted such that they can be brought, preferably swivelled, from a rest position (50) into a catching position (46) and back again, and a control element (44), preferably in the form of a rocker arm, is provided in the region of the conveying zone for the catches (36) which are always effectively conveying, for the swivelling each time of the corresponding catches (36) into the catching position (46).

5. An apparatus as claimed in claim 2, wherein two mutually parallel-running, laterally spaced apart and synchronously circulating drawing members (34) are provided with catches (36, 36'), the mutually corresponding catches (36; 36') of both drawing members (34) being mutually aligned in the conveying direction (F).

6. An apparatus as claimed in claim 1, wherein the retaining device (56) has a support (58), in the form of a platform, for the printing products (18), having holes (60) which can be connected or are connected to a low-pressure source.

7. An apparatus as claimed in claim 1, which comprises a guiding device (70) having a drawing element (74), which is driven in circulation counter to the direction of rotation (A) of the paddle wheel (10) and has catching elements (76) arranged on it at intervals one behind the other, the path of movement (74') of which catching elements crosses the conveying plane (68) of the delivery conveyor (26) at the depositing point (24), the catching elements (76) being able to be brought into effect on the trailing edges (52) of the printing products (18) upstream of the depositing point (24), and the retaining device (56) bringing the catching elements (76) out of engagement with the printing products (18).

* * * * *